US007415996B2

(12) United States Patent
Favreau

(10) Patent No.: US 7,415,996 B2
(45) Date of Patent: Aug. 26, 2008

(54) INVERTED CONTAINER HOLDING SYSTEM, APPARATUS, AND METHOD

(76) Inventor: Kimberly Favreau, 393 Brownell Rd., Ballston Spa, NY (US) 12020

( * ) Notice: Subject to any disclaimer, the term of this patent is extended or adjusted under 35 U.S.C. 154(b) by 0 days.

(21) Appl. No.: 11/420,153

(22) Filed: May 24, 2006

(65) Prior Publication Data

US 2007/0272329 A1 Nov. 29, 2007

(51) Int. Cl.
*B65B 1/04* (2006.01)

(52) U.S. Cl. ..... 141/364; 141/98

(58) Field of Classification Search ..... 141/98, 141/364–367, 375, 88, 106; 248/311.3, 312, 248/312.1, 311.2; 211/74, 85
See application file for complete search history.

(56) References Cited

U.S. PATENT DOCUMENTS 1,350,739 A * 8/1920 Rose ..... 222/47
3,603,551 A * 9/1971 Peterson ..... 248/314
3,615,150 A * 10/1971 Indrunas ..... 141/375
4,271,878 A * 6/1981 Bologa ..... 141/375
D311,477 S 10/1990 Fallgatter et al.
5,080,150 A 1/1992 Deadwyler, Jr.
5,215,133 A 6/1993 Lambert
D342,866 S 1/1994 Lee
5,297,600 A 3/1994 Downes et al.
5,794,904 A * 8/1998 Hackley ..... 248/311.3
6,220,458 B1 * 4/2001 Falor ..... 211/74
6,481,685 B1 * 11/2002 Cormier ..... 248/311.3
D488,962 S 4/2004 Catt

* cited by examiner

*Primary Examiner*—Steven O Douglas
(74) *Attorney, Agent, or Firm*—Schmeiser, Olsen & Watts

(57) ABSTRACT

Provided is an inverted container holding apparatus comprising a securing member and a retaining member. The securing member includes a region configured to receive and secure an inverted container, wherein securing is enhanced by a resiliently flexible material. The retaining member may be removably attachable to the securing member to form a unitary structure or may be attached to a support member which is in turn attached to the securing member to form a unitary structure. A corresponding method of accessing contents of a container includes the provision of an inverted container holding apparatus having a retaining member, wherein the retaining member is configured to capture and retain contents that may vacate the inverted container after it is inserted into the holding apparatus.

18 Claims, 4 Drawing Sheets

INVERTED CONTAINER HOLDING SYSTEM, APPARATUS, AND METHOD

BACKGROUND OF THE INVENTION

1. Technical Field

This invention relates generally to extracting contents from containers. More particularly, this invention provides an apparatus and methods which supports an inverted container such that contents may move near the container opening for easy access.

2. Related Art

Restaurant professionals, condiment connoisseurs, mechanics, and others who deal with containers often find it difficult to extract the final remaining contents from their containers, especially where the container contents include semi-viscous fluids. Most common is the case of ketchup in the ketchup bottle, but a wide variety of other condiments and household items can cause just as much grief. The simple solution to this problem is easily recognizable to many—invert the container and wait for gravity to draw the contents down toward the opening. When the container is opened the contents can be easily removed. The problem is that many content hoarding containers are not easy to stand on end and may readily tip over.

Attempts have made to solve this problem, including the provision of known devices designed to hold an inverted container using various implements and designs, i.e. concentric steps, flexible fingers, etc. Some devices have even removed the need for keeping the lid on the container while it's inverted—cups or other containers are placed below the inverted, open container. The cups are not attached to the rest of the apparatus. This makes the devices cumbersome because the cups or catching elements can be lose, may spill easily, and the devices are not easy to store in a refrigerator, place on a shelf, etc.

Accordingly, there is a need for a clean and efficient way to save the last remaining contents of containers. Hence, the present invention relates to new and useful improvements in an inverted container holding apparatus, system, and method.

SUMMARY OF THE INVENTION

A first aspect of the present invention is an inverted container holding apparatus comprising: a securing member, including a region configured to receive and secure an inverted container, said region having a resiliently flexible material; and a retaining member, having a base portion and a support portion, said support portion removably attachable to the securing member to form a unitary structure, wherein the retaining member is configured to capture and retain contents that vacate the inverted container.

A second aspect of the present invention is an inverted container holding apparatus comprising: a retaining member, configured to capture and retain contents originating from a container; and a support member, removably attachable to the retaining member; and a securing member, removably attachable to the support member, including a region that accepts the container when inverted, said region including a compliant component configured to make secure physical contact with the container.

A third aspect of the present invention provides a method of accessing contents of a container, said method comprising: providing an apparatus including: a securing member, said securing member including a region configured to receive and secure a container, said region having a resiliently flexible material; and a retaining member removably attachable to the securing member, said retaining portion configured to capture and retain contents originating from the container; inverting the container, said container having contents contained therein; inserting said container into the apparatus so that the securing member secures the container in a point of stable equilibrium; allowing gravity to work upon the contents of the container causing the contents to move; and retrieving the contents of said container.

BRIEF DESCRIPTION OF THE DRAWINGS

Some embodiments of this invention will be described in detail, with reference to the following figures, wherein like designations denote like members, wherein.

DETAILED DESCRIPTION OF THE INVENTION

Figure 1:
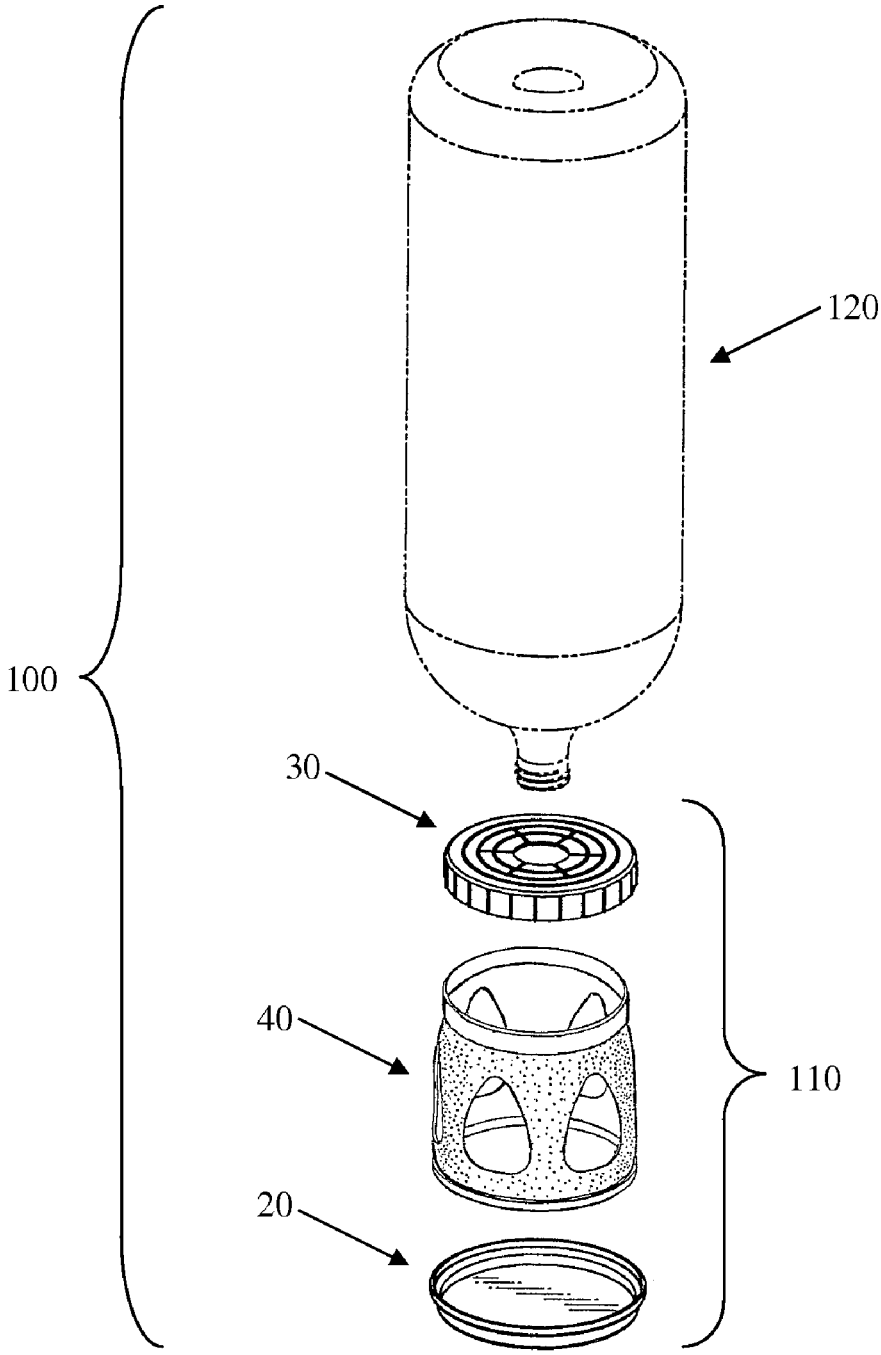
FIG. 1 is an exploded perspective view of an embodiment of an inverted container holding system, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts a perspective view of an embodiment of an inverted container holding system 100 including an inverted container holding apparatus 110, in accordance with the present invention. An inverted container holding apparatus 110 may have a retaining member 20, a securing member 30, and a support member 40.

Figure 2:
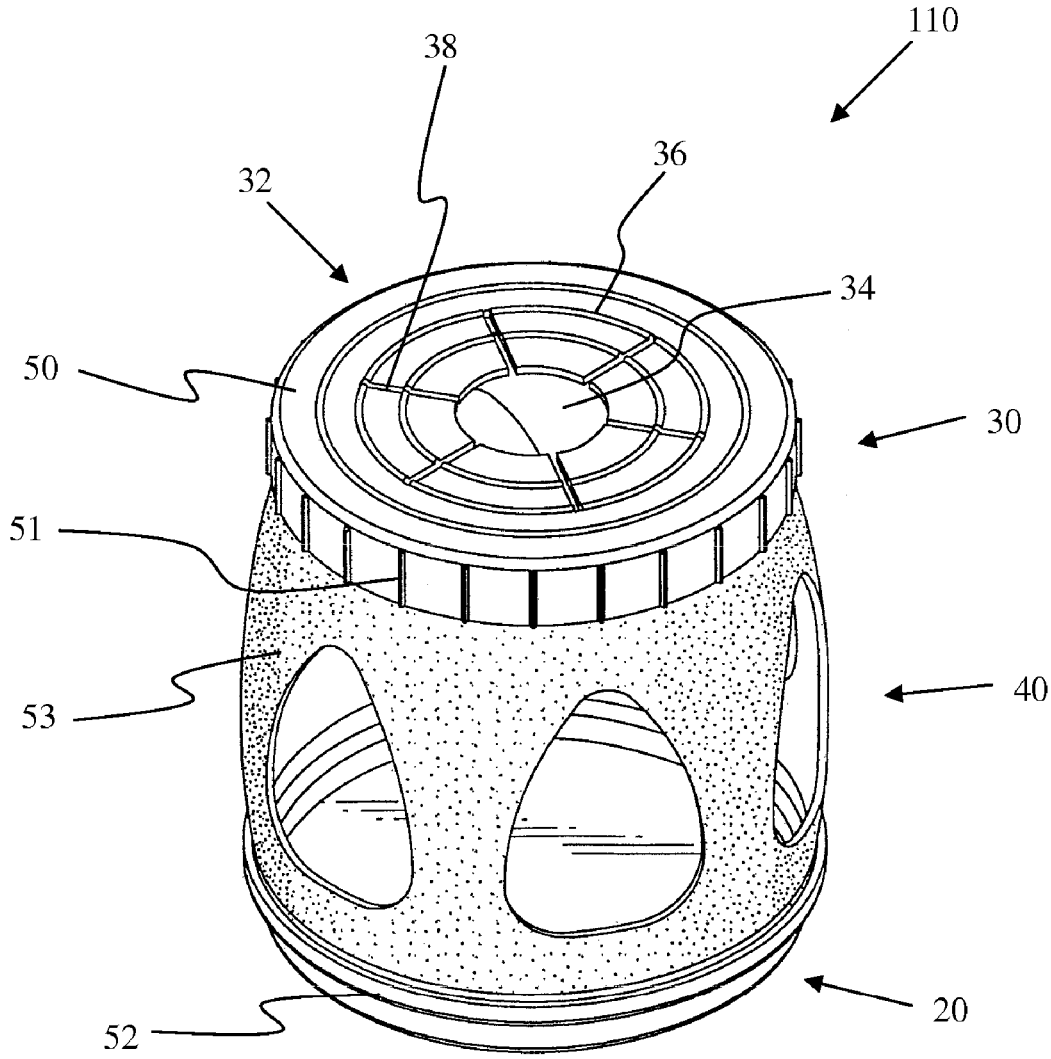
FIG. 2 is a perspective view of an embodiment of an inverted container holding apparatus, in accordance with the present invention.

With further reference to the drawings, FIG. 2 depicts a perspective view of an embodiment of an inverted container holding apparatus 110, in accordance with the present invention. A securing member 30 may have a region 32 configured to receive and secure an inverted container 120. A region 32 may be constructed of resiliently flexible material such as plastic, rubber, silicone, thin metal, or any other resiliently flexible material. Materials may be dishwasher safe i.e., able to withstand high temperatures and cleaning agents in a dishwasher environment. A region 32 configured to receive and secure an inverted container 120 may comprise and may be described in terms of general classifications of features which perform various functions. These include: primary securing features 34, secondary securing features 36, stiffness/compliance adjustment features 38, and friction altering features 50.

The first feature for discussion is a primary securing feature 34. A primary securing feature 34 may define the initial form of an opening for receiving and securing an inverted container 120. Some examples an initial form may be: planar with at least one slit; planar with a hole; conical with at least one slit; conical with a hole; or cylindrical. A primary securing feature 34 may experience gross deformation as it adjusts for the size and shape of an inverted container 120 (i.e. planar with at least one slit), or it may simply provide an attachment foundation for secondary securing features (i.e. cylindrical), or it may perform some combination of the two preceding examples (i.e. planar with at least one slit with secondary securing features attached).

A primary securing feature may be in direct physical contact with an inverted container 120 while receiving and securing it. A region 32 of the securing member 30 may be configured to facilitate efficient flexure to permit insertion of an inverted container 120. Accordingly, a primary securing feature 34 may allow a region 32 to open and grow in size as an inverted container 120 is inserted into or through the region 32. A growth in size of an opening in the region 32 may happen in part because, as an inverted container 120 is inserted, the sides of the at least one slit may be pushed in the direction of insertion and may splay outward. In this way, the securing member 30 comprised of the at least one primary securing feature 34 which may accommodate a range of sizes and shapes. For example, a region 32 may comprise a hole 34 configured to receive an inverted container 120 wherein the hole 34 may stretch and expand to allow an inverted container 120 to be inserted to a point of stable equilibrium. As an inverted container 120 is inserted, the edge of the hole 34 may be pushed in the direction of insertion and the hole will expand to fit an inverted container 120. In this way, a securing member 30 comprising a hole 34 may accommodate a range of sizes and shapes.

A second feature of a region 32 for receiving and securing an inverted container 120 is a secondary securing feature 36. A region 32 may have features configured to secure an inverted container 120 in addition to that provided by a primary securing feature 34. Secondary securing features 36 may be connected to a primary securing feature 34 and may enhance the ability of a primary securing feature 34 to receive and secure an inverted container 120. Secondary securing features 36 may be in direct physical contact with an inverted container 120 while receiving and securing it. The form of a secondary securing feature 36 may be configured to restrict movement of an inverted container 120 when in they are in contact. A secondary securing feature 36 may deflect or deform in response to contact from an inverted container 120 or a secondary securing feature 36 may remain substantially unchanged in shape when in contact with an inverted container 120. Non-limiting examples of secondary securing features may include: a few small, relatively stiff, concentric raised rings; or numerous small, compliant, finger-like protrusions. Concentric raised rings 36 may provide support for an inverted container 120 by forming a physical barrier to further insertion. As a resiliently flexible material in region 32 is deflected in the direction of insertion, more concentric raised rings 36 may be brought into direct physical contact with an inverted container 120. Concentric raised rings 36 may also provide lateral support to an inverted container 120. An inverted container 120 may be inserted until a point of stable equilibrium is reached.

A third feature of a region 32 for receiving and securing an inverted container 120 may be stiffness/compliance adjustment features 38. These features 38 may be incorporated in primary 34 or secondary 36 securing features. A region 32 may have features 38 configured to increase stiffness of securing structures. An example of a feature designed to enhance stiffness may be in the form of ribs, buttresses, selectively placed materials, special geometry, or any other feature or design that may increase stiffness. A region 32 may have features 38 configured to increase compliance of a securing structure such as slits, grooves, recesses, dimpling, cuts, holes, selectively placed materials, special geometry, or any other like feature that may increase compliance. For example, several connecting slits in a region 32 may increase compliance by creating segments in the region 32. These segments may allow for a primary securing feature 34 (i.e. a hole) to be more easily enlarged by an inverted container 120. Features 38 may be applied globally or locally, individually or in any combination to adjust the stiffness/compliance of a region 32.

A fourth aspect of a region 32 for receiving and securing an inverted container 120 may be friction altering features 50. Friction altering features 50 may be present anywhere in any combination on a surface of a securing member 30. Examples of friction altering features 50 may include ridges, grooves, dimples, bumps, depressions, pebbling, cross-hatching, knurling, high friction material such as low durometer rubber, low friction material such as teflon, or any other friction altering feature. If a region 32 is not already constructed of slip-resistant material, it may have slip-resistant coating on surfaces which may be in contact with an inverted container 120.

Stiffness/compliance adjustment features 38 and friction altering features 50 may be incorporated in any primary 34 or secondary 36 securing feature, independently or in any combination, to aid in receiving and securing an inverted container 120. For example, a region 32 may comprise pebbled slip-resistant material for increased friction, a network of ribs to increase overall stiffness of a primary securing feature 34, and strategically located dimples to locally increase compliance of a primary securing feature 34. All stiffness/compliance features 38 and friction altering features 50 in the aforementioned example may be configured to work in concert to provide the amount of support necessary to maintain an inverted container 120 in stable equilibrium.

A securing member 30 may be removably attachable to a retaining member 20 or a support member 40 by such means as threading, interference fitting of rigid/semi-rigid components, stretching a flexible component over another more rigid component, interlocking detents, locking lever arms, or any other means for removably attaching a securing member 30 to a retaining member 20 or a support member 40. A securing member 30 may include additional features configured to aid in the removal of a securing member 30 from a retaining member 20 or a support member 40. Additional features may provide leverage such as lips, ledges, tabs, or any other feature that may improve leverage or may provide an appropriate area in which to apply the force necessary to either attach or separate a retaining member 20 and a securing member 30 or a support member 40. Additionally, a securing member 30 may include friction altering features 51 designed to enhance friction such as grooves, dimples, bumps, depressions, pebbling, cross-hatching, knurling, or any other friction enhancing feature.

A support member 40 serves as an intermediate support structure between a retaining member 20 and a securing member 30. A support member 40 may be formed of plastic, ceramic, glass, rubber, silicone, wood, metal, metal alloy, composite material, and/or any other material suitable for use in an inverted container holding apparatus 110, and/or any combination of materials thereof. A transparent material may allow for visual inspection of an inverted container's contents within a system 100 without the need for disassembly. Materials may be dishwasher safe i.e., able to withstand high temperatures and cleaning agents in a dishwasher environment. One embodiment of a support member 40, which is represented in FIG. 2, may be a generally conically shaped section, where the smaller end may be removably attached to a securing member 30 and the larger end may be removably attached to a retaining member 20. Further examples are a support member 40 comprised of removably attachable components in accordance with the present invention which may include a hollow cylinder, or a single or multi-legged structure configured at each end to be removably attachable to a retaining member 20 and a securing member 30. A support member 40 may be any shape of any size, so long as a support member 40 is operably attachable with a retaining member 20 and a securing member 30 to form a unitary structure that is functional to retain contents that vacate an inverted container 120 secured by a securing member 30. For example, a support member 40 may have a hollow oval cross-section extending from a removably attachable retaining member 20 to a removably attachable securing member 30.

A support member 40 may be an open or a closed structure. An open structure is one in which there are interspersed gaps or spaces in excess of those necessary to interface with a retaining member 20 or a securing member 30. A closed structure does not contain any excess gaps or spaces. In the context of the present invention, a closed structure may be a hollow cylinder removably attachable at each end to a retaining member 20 and a securing member 30. Notwithstanding the fact that a hollow cylinder has openings at each end, it is considered to be a closed structure. Examples of a closed structured support member 40 may include any hollow extruded geometric shape with openings at each end only. An open structured support member 40 may include any hollow extruded geometric shape with some form of hole or holes present in a sidewall or sidewalls such as: decorative hole patterns, meshes, basket weaves, etc. The preceding examples are considered to be open structures because all contain openings in addition to the openings at each end. A further example of an open structured support member 40 may be support legs of any form, such as columns, providing a space between a receiving member 20 and a securing member 30.

Friction altering features 53 may be present anywhere in any combination on a surface of a support member 40. Examples of friction altering features may include ridges, grooves, dimples, bumps, depressions, pebbling, cross-hatching, knurling, high friction material, low friction material, or any other friction altering feature. If a friction altering feature comprises a material, that material may be present anywhere on a support member 40. For example, a support member 40 may have a slip-resistant coating or a slip-resistant material incorporated into an exterior body region of a support member 40.

A support member 40 may be removably attachable to a securing member 30 and/or a retaining member 20 by such means as threading, interference fitting of rigid/semi-rigid components, stretching a flexible component over another more rigid component, interlocking detents, locking lever arms, or any other means for removably attaching a support member 40 to a securing member 30 and/or a retaining member 20. A support member 40 may include additional features configured to aid in the removal of a support member 40 from a securing member 30 and/or a retaining member 20. Additional features may provide leverage such as lips, ledges, tabs, or any other feature that may improve leverage or may provide an appropriate area in which to apply the force necessary to either attach or separate support member 40 and a securing member 30 and/or a retaining member 20. Such features may include friction enhancing features such as grooves, dimples, bumps, depressions, pebbling, cross-hatching, knurling, or any other friction enhancing feature.

Figure 3:
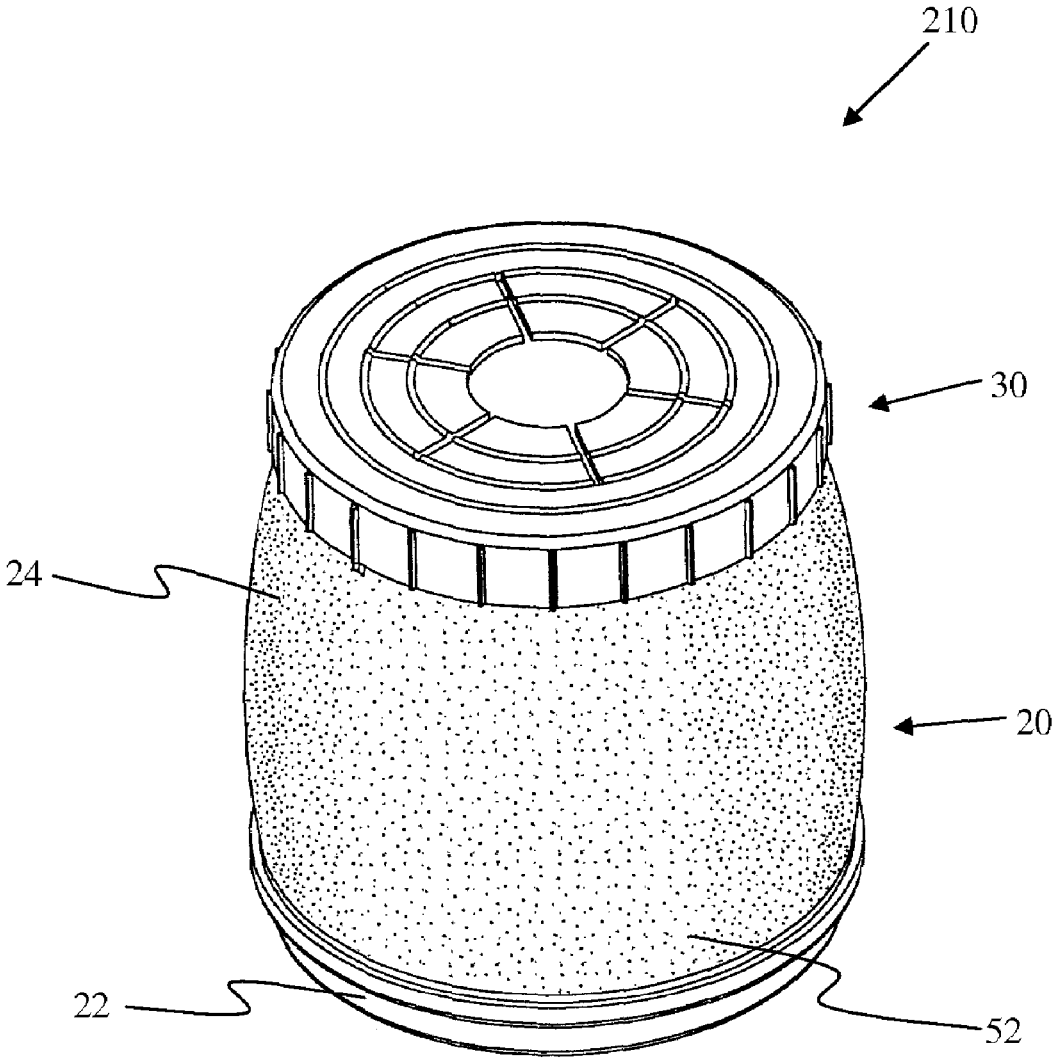
FIG. 3 is a perspective view of another embodiment of an inverted container holding apparatus having a cup-like retainer member, in accordance with the present invention.

Referring further to FIGS. 1-2 and with additional reference to FIG. 3, a perspective view of an embodiment of an inverted container holding apparatus 210 is depicted, in accordance with the present invention. A key attribute of a retaining member 20 is that the retaining member may provide means of capturing and retaining contents that may deposit from an inverted container 120. A retaining member 20 may be formed of plastic, ceramic, glass, rubber, silicone, wood, metal, metal alloy, composite material, and/or any other material suitable for use in an inverted container holding apparatus 110, and/or any combination of materials thereof. A transparent material may allow for visual inspection of an inverted container's contents within a system 100 without the need for disassembly. Materials may be dishwasher safe i.e., able to withstand high temperatures and cleaning agents in a dishwasher environment. In accordance with the present invention, a retaining member 20 may be comprised of a single component, or unitary structure, such as an object resembling a cup, as shown in FIG. 3. On the other hand, and also in accordance with the present invention, a retaining member 20 may be fashioned to resemble a shallow dish, the dish being attachable to a support member 40, as depicted in FIGS. 1-2. A retaining member 20 may comprise any shape of any size, so long as the retaining member 20 is either operably attachable with a securing member 30 to form a unitary structure or is operably attachable with a support member 40 which is operably attachable with a securing member 30 to form a unitary structure, and so long as the retaining member is functional to retain contents that vacate an inverted container 120 secured by a securing member 30. Where a retaining member 20 is shaped like a cup, as is depicted in FIG. 3, the retaining member 20 may have a base portion 22 and a support portion 24. The support portion 24 may be integrally joined with the base portion 22 to form a single cup-like structure being the retaining member 20. For example, a retaining member 20 may have a hollow, generally conically shaped cylinder support portion 24 extending from a base portion 22.

Friction altering features 52 may be present anywhere in any combination on a retaining member 20. Examples of friction altering features 52 may include ridges, grooves, dimples, bumps, depressions, pebbling, cross-hatching, knurling, high friction material such as low durometer rubber, low friction material such as teflon, or any other friction altering feature. If a friction altering feature comprises a material, that material may be present anywhere on a retaining member 20. For example, a retaining member 20 may have slip-resistant coating on a surface in contact with a supporting surface (in this case part of a stable support) or a slip-resistant material may be incorporated into an exterior body region of a retaining member 20.

A retaining member 20 may be removably attachable to a securing member 30 by such means as threading, interference fitting of rigid/semi-rigid components, stretching a flexible component over another more rigid component, interlocking detents, locking lever arms, or any other means for removably attaching a retaining member 20 to a securing member 30. Where a retaining member 20 has a base portion 22 and a support portion 24, the support portion 24 is removably attachable to a securing member 30. A retaining member 20 may include additional means and features configured to aid in the removal of a retaining member 20 from a securing member 30. Additional features may provide leverage such as lips, ledges, tabs, or any other feature that may improve leverage or may provide an appropriate area in which to apply the force necessary to either attach or separate a retaining member 20 and a securing member 30. Such features may include friction altering features 52 designed to enhance friction such as grooves, dimples, bumps, depressions, pebbling, cross-hatching, knurling, or any other friction enhancing feature. Furthermore, a retaining member 20 may be removably attachable to a support member 40 via means similar to those discussed supra in relation to a retaining member 20 being removably attachable to a securing member 30.

An inverted container holding system 100 may be configured to rest upon a supporting surface such as a counter top, table top, bathtub shelf, shower shelf, window sill, work bench, refrigerator shelf, or any other like surface that may support an inverted container holding system 100. Stable support may be provided by a removably attachable, permanently affixed, or integral component that shares functionality with any another feature or component of a retaining member 20, a securing member 30, or a support member 40. Any surface of any component that may come in contact with a supporting surface may include friction enhancing features in any combination. Examples of friction enhancing features may include ridges, grooves, dimples, bumps, depressions, pebbling, cross-hatching, knurling, high friction material such as low durometer rubber, or any other friction enhancing feature. Stable support for an inverted container holding system 100 may be configured to adhere to a flat surface by means of suction. Suctioning means may be removably attachable, permanently affixed, or an integral component that shares functionality with any another feature or component of a retaining member 20, a securing member 30, or a support member 40. Additionally, an inverted container holding apparatus 110 may include means for lifting such as handles, rings, loops, etc. Means for lifting may be removably attachable, permanently affixed, or an integral component that shares functionality with any another feature or component of a retaining member 20, a securing member 30, or a support member 40.

A retaining member 20 may include a stable support configured to rest upon a supporting surface such as a counter top, table top, bathtub shelf, shower shelf, window sill, work bench, or any other like surface that may support an inverted container holding system 100. One embodiment of a retaining member 20, which is represented in FIG. 3, may be a hollowed section of a cone where the smaller end may be removably attached to a securing member 30 and the larger end may be in contact with a supporting surface. In this case, the larger end is both a base portion 22 of a retaining member 20 and a stable support for an inverted container holding system 100. On the other hand, a stable support may be an additional component of a retaining member 20 assembly and may be attachable to any member or component of the assembly. A stable support may take the form of a flat circular plate, a cruciform, a tripod, a conical shape with the wide end in contact with a supporting surface, or any other means for providing stable support for a system 100.

Figure 4:
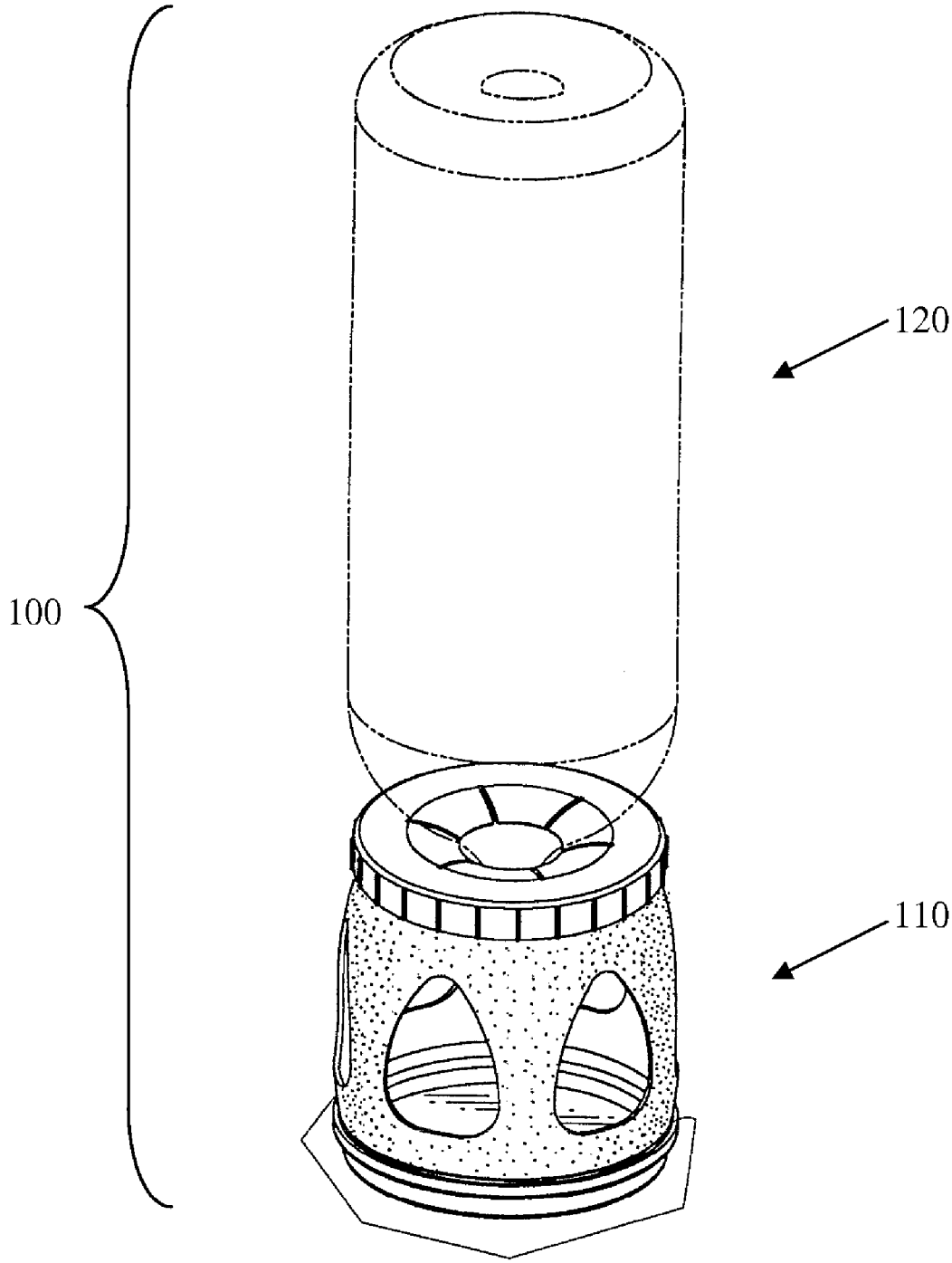
FIG. 4 is a perspective view of an embodiment of an inverted container holding system, shown holding an inverted container, in accordance with the present invention.

A method of accessing contents of a container is now described with reference to FIG. 4 and with further reference to FIGS. 1-3. One methodological step of accessing contents of a container may be to provide an apparatus 110. The provided apparatus 110 may comprise a securing member 30. The securing member 30 may include a region 32 configured to receive and secure a container, with the region having a resiliently flexible material. Moreover, the provided apparatus 110 may also comprise a retaining member 20 removably attachable to the securing member 30, with the retaining member 20 configured to capture and retain contents originating from a container 120.

An additional methodological step of accessing contents of a container may be to invert a container 120, with the container having dispensable contents. Types of containers may include condiment bottles, salad dressing bottles, jam/jelly jars or bottles dish soap bottles, liquid laundry detergent bottles, shampoo bottles, etc. Container shapes may be cylindrical, oval, conical, cubical, etc. Still further, another methodological step of accessing contents of a container may be to insert the container 120 in an inverted state into the apparatus 110 so that the securing member 30 secures the container 120 in a point of stable equilibrium. Another methodological step of accessing contents of a container may be to allow gravity to work upon the contents of the container causing the contents to move. Yet another methodological step of accessing contents of a container may be to retrieve the contents of the container 120.

Retrieving the contents may include taking the container 120 out of the apparatus 110, opening said container 120, and extracting the moved contents. However, the inserted container 120 may be open so that the contents move as acted upon by gravity or other means and vacate the container 120 and collect in the retaining member 20. After contents of an inverted container 120 have vacated and are located in a receiving member 20, the inverted container may be removed from an apparatus 110. Furthermore, a securing member 30 may also be removed from a receiving member 20 and in its place a lid or other sealing member may be removably attached to a receiving member 20 or support member 40 to seal the vacated contents inside a closed inverted container holding apparatus 110. Additionally, a lid may be removably attached to a securing member 30 without removing a securing member 30 from a receiving member 20. In this case, both the lid and a securing member 30 may be removed from a receiving member 20 or support member 40 together as one unitary structure.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. An inverted container holding apparatus comprising:

a securing member, including a region configured to receive and secure an inverted container, said region having a resiliently flexible material, wherein the region experiences gross deformation and adjusts for the size and shape of the inverted container as the region flexes to open and grow in size when the inverted container is received and includes raised concentric rings configured to provide additional support for the inverted container; and a retaining member, having a base portion and a support portion, said support portion removably attached to the securing member to form a unitary structure, wherein the retaining member is comprised of material that is rigid and unlike the resiliently flexible material of the securing member and the retaining member is configured to capture and retain contents that vacate the inverted container.

2. The inverted container holding apparatus of claim 1, wherein said retaining member has slip resistant material on an exterior surface.

3. The inverted container holding apparatus of claim 2, wherein said support portion is a generally conically shaped cylinder with a smaller end being removably attachable to said securing member.

4. The inverted container holding apparatus of claim 1, wherein the apparatus is formed of dishwasher safe materials.

5. The inverted container holding apparatus of claim 1, wherein said region of resiliently flexible material of said securing member has at least one slit configured to receive and secure an inverted container.

6. The inverted container holding apparatus of claim 1, wherein said support portion of said retaining member is formed of substantially transparent material.

7. An inverted container holding apparatus comprising:

a rigid retaining member, configured to capture and retain contents originating from a container;

a support member, removably attached to the retaining member; and a securing member, removably attached to the support member, the securing member including a region that accepts the container when inverted, said region including a compliant component configured to bend in contact with the inverted container and exert an opposing force upon the container to make secure physical contact with the container, wherein the compliant component includes flexible material properties that are different from rigid material properties of the retaining member, and, wherein the region experiences gross deformation and adjusts for the size and shape of the inverted container as the region flexes to open and grow in size when the inverted container is accepted and includes raised concentric rings configured to provide additional support for the inverted container.

8. The inverted container holding apparatus of claim 7, wherein said support member includes at least one leg.

9. The athletic inverted container holding apparatus of claim 7, wherein said support member is open only at attachable interfaces with said retaining member and said securing member.

10. The inverted container holding apparatus of claim 7, wherein said support member includes at least one opening in addition to openings that interface with said retaining member and said securing member.

11. The inverted container holding apparatus of claim 7, wherein said region of the securing member has a primary feature configured to grow in size as an inverted container is inserted and provide support for said container.

12. The inverted container holding apparatus of claim 7, wherein the support member is substantially transparent.

13. The inverted container holding apparatus of claim 7, wherein the apparatus is formed of dishwasher safe materials.

14. A method of accessing contents of a container, said method comprising:

providing an apparatus including:

a securing member, said securing member including a region configured to receive and secure a container, said region having a resiliently flexible material, wherein the region experiences gross deformation and adjusts for the size and shape of the inverted container as the region flexes to open and grow in size when the inverted container is received and includes raised concentric rings configured to provide additional support for the inverted container; and a rigid retaining member removably attached to the securing member, said retaining member configured to capture and retain contents originating from the container, wherein the retaining member has rigid material properties that are different from resilient material properties of the securing member;

inverting the container, said container having contents contained therein;

inserting said container into the apparatus so that the resilient material of the securing member bends and secures the container in a point of stable equilibrium;

allowing gravity to work upon the contents of the container causing the contents to move; and retrieving the contents of said container.

15. The method of accessing contents of a container of claim 14, wherein retrieving further includes taking said container out of the apparatus, opening said container, and extracting the moved contents.

16. The method of accessing contents of a container of claim 14, wherein the inserted container is open so that the moved contents vacate and collect in the retaining member.

17. The method of accessing contents of a container of claim 16, wherein retrieving further includes removing the retaining member to expose the vacated contents collected in the retaining member.

18. The method of accessing contents of a container of claim 17, further including extracting vacated contents from the retaining member.

* * * * *